US005568714A

United States Patent [19]

Peterson

[11] Patent Number: 5,568,714

[45] Date of Patent: Oct. 29, 1996

[54] SPACER-FRAME BAR HAVING INTEGRAL THERMAL BREAK

[75] Inventor: Wallace H. Peterson, Burnaby, Canada

[73] Assignee: Alumet Manufacturing Inc., Coquitlam, Canada

[21] Appl. No.: 443,117

[22] Filed: May 17, 1995

[51] Int. Cl.[6] ..... E06B 7/00

[52] U.S. Cl. ..... 52/786.13; 52/730.4; 52/172; 52/717.02

[58] Field of Search ..... 52/786.13, 786.1, 52/172, 730.4, 730.5, 732.2, 717.02, 204.593, 204.595; 428/34

[56] References Cited

U.S. PATENT DOCUMENTS

| | | | |
|---|---|---|---|
| 3,823,524 | 7/1974 | Weinstein | 52/717.02 |
| 4,057,945 | 11/1977 | Kessler | 52/786.13 X |
| 4,222,213 | 9/1980 | Kessler | 52/786.13 |
| 4,312,905 | 1/1982 | Kreusel | 52/730.5 X |
| 4,342,144 | 8/1982 | Doguchi | 52/730.4 X |
| 4,688,366 | 8/1987 | Schmidt | 52/717.02 |
| 5,087,489 | 2/1992 | Lingemann | 52/786.13 X |
| 5,313,762 | 5/1994 | Guillemet | 52/786.13 |
| 5,424,111 | 6/1995 | Farbstein | 52/172 X |

FOREIGN PATENT DOCUMENTS

| | | | |
|---|---|---|---|
| 0575428 | 2/1946 | United Kingdom | 52/730 A |
| 80001930 | 9/1980 | WIPO | 52/730.4 |
| 94017260 | 8/1994 | WIPO | 52/172 |

*Primary Examiner*—Robert Canfield

*Attorney, Agent, or Firm*—Christensen, O'Connor, Johnson & Kindness PLLC

[57] ABSTRACT

An elongate tubular spacer-frame bar (18) having an integral thermal break for reducing energy flow between glass panes (14) in an insulated glass panel (10) is provided. The spacer-frame bar (18) includes a first and a second side (24, 25), each side having elongated edges (28, 29). Two non-welded seams (26) run along the elongate dimension of the spacer-frame bar between the corresponding adjacent edges of the first and second sides. At least one continuous insulating member (30), composed of a nonmetallic, low-heat-conductive substance, and being of a length substantially equal to the length of the spacer-frame bar, separates the first and second sides of each seam, forming a thermal break. The present invention effectively eliminates all direct contact between the spacer-frame bars and the glass panes by separating the two halves of the spacer-frame bar along its nonwelded seams with a nonmetallic/nonconductive substance. This separation creates an effective thermal break along the spacer-frame bar that stops conductivity between the glass panes via the spacer-frame bar, thus further reducing the heat loss in insulated glass panels.

25 Claims, 8 Drawing Sheets

SPACER-FRAME BAR HAVING INTEGRAL THERMAL BREAK

FIELD OF THE INVENTION

The present invention relates to spacer-frame bars used to maintain a separation between glass panes in insulated glass panels and, in particular, to spacer-frame bars having integral thermal breaks.

BACKGROUND OF THE INVENTION

It is well known in the art to provide a window having more than one pane of glass, the panes being separated by an airspace. Such windows are known as insulating windows or insulated glass panels by virtue of the fact that the air or other gaseous material (argon, helium, nitrogen, et cetera) trapped within the space between the glass panes serves as an insulator to reduce heat flow through the glass. Typically, the glass panes are separated by a spacer frame comprised of sections of tubing joined together at adjacent ends to form a continuous frame. The spacer frame lies between the glass panes and extends around their perimeter. The tubes comprising the spacer frame, also known as spacer-frame bars, are commonly made of aluminum or metals, such as steel or stainless steel, since, in addition to being commercially economical, these materials are sufficiently strong and rigid to permit the tubes to function as spacer-frame bars. Also, aluminum and steel exhibit good corrosion resistance, and their structural integrity is not adversely affected by long-term exposure to sunlight.

In order to keep the air trapped within the space between the glass panes as dry as possible to prevent the glass panes from fogging, it is essential that the spacer frames be and remain hermetically attached to the glass panes throughout the expected life of the insulated glass panels. To assure a hermetic bond between the spacer frames and the glass panes, a mastic-like sealant material is generally heated and applied to the outside faces of the spacer frames where it flows into sealing and bonding contact between the glass and the spacer-frame bars. Alternately, the hermetic bond can be formed by application of a two-part sealant consisting of a resinous adhesive and a catalyst that reacts with the adhesive to cure the sealant. This process typically requires contriver between the spacer-frame bars and the glass panes to maintain structural strength in the insulated glass panels and to prevent seepage of the heated sealant material beyond the spacer-frame bars and onto the visible portions of the insulated glass panels.

Since the introduction of insulated glass panels, great benefits have been derived in the form of diminished heat loss and increased energy savings based on the insulation effect provided by the air trapped between the glass panes. So great has that savings been that little thought was given to additional areas of heat loss within the insulated glass panels. It has since been realized that, despite representing a relatively small percentage of the entire insulated glass panel, the physical contact between the spacer-frame bars and the glass panes results in substantial energy loss through the area of the frame. The spacer-frame bars, metallic in nature and highly heat conductive, act to transfer energy between the glass panes with obvious heat-loss implications.

SUMMARY OF THE INVENTION

The present invention provides an elongate tubular spacer-frame bar having an integral thermal break for reducing energy flow between glass panes in insulated glass panels. The spacer-frame bar includes a first and a second side, each side having elongated edges. Two nonwelded seams run along the elongate dimension of the spacer-frame bar between the corresponding adjacent edges of the first and second sides. At least one continuous insulating member, composed of a nonmetallic, low-heat-conductive substance, and being of a length substantially equal to the length of the spacer-frame bar, separates the first and second sides of each seam, forming a thermal break.

In accordance with further aspects of this invention, each seam includes a series of tabs formed in the edge of the first side and opposed to a series of tabs formed in the edge of the second side, the opposing tabs alternately overlying and underlying one another in an interleaved fashion. In one embodiment, the continuous insulating member is woven between the interleaved tabs of the edges of the first and second sides. In an alternate embodiment, a layer of insulating material is interposed between the opposing alternately overlying and underlying tabs.

In accordance with other aspects of this invention, each seam includes a series of tabs formed in the edge of the first side that alternately overlie and underlie the edge of the second side. In one embodiment, an insulating member runs along both sides of the edge of the second side between the alternately overlying and underlying tabs of the edge of the first side. In an alternate embodiment, the insulating member includes at least one V-shaped member that extends over the edge of the second side and between the alternately overlying and underlying tabs of the edge of the first side. In yet an alternate embodiment, a layer of insulating material is interposed between the edges of the second side and the opposing alternately overlying and underlying tabs of the edge of the first side. In still an alternate embodiment, nonconductive separators are interposed between the edge of the second side and between the alternately overlying and underlying tabs of the edge of the first side to prevent contact between the edges of the first and second sides.

In accordance with still further aspects of this invention, each seam includes an elongate channel formed along the edge of the first side corresponding to a ridge formed along the edge of the second side and engaging the elongate channel. In one embodiment, a continuous insulating member is adapted to seat between the elongate channel of the first side and the ridge of the second side. In an alternate embodiment, a layer of insulating material is interposed between the elongate channel of the first side and the ridge of the second side. In yet an alternate embodiment, nonconductive separators are interposed between the elongate channel of the first side and the ridge of the second side and interspaced to prevent contact between the edges of the first and second sides.

In accordance with still further aspects of this invention, each seam includes an elongate channel formed along the edge of the first side and a corresponding elongate channel formed along the edge of the second side, the channels interfit to form the seam. In one embodiment, a continuous insulating member is adapted to seat between the corresponding interlocking channels. In an alternate embodiment, a layer of insulating material is interposed between the elongate channels. In yet another embodiment, nonconductive separators are interposed between the elongate channels and interspaced to prevent contact between the edges of said first and second sides.

In accordance with further aspects of this invention, the insulating member of the spacer-frame bar is composed of a nonmetallic, low-heat-conductive substance such as rubber or plastic.

The present invention effectively eliminates all direct contact between the spacer-frame bars and the glass panes by separating the two halves of the spacer-frame bar along its nonwelded seams with a nonmetaic/nonconductive substance. This separation creates an effective thermal break along the spacer-frame bar that stops conductivity between the glass panes via the spacer-frame bar, thus further reducing the heat loss in insulated glass panels.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
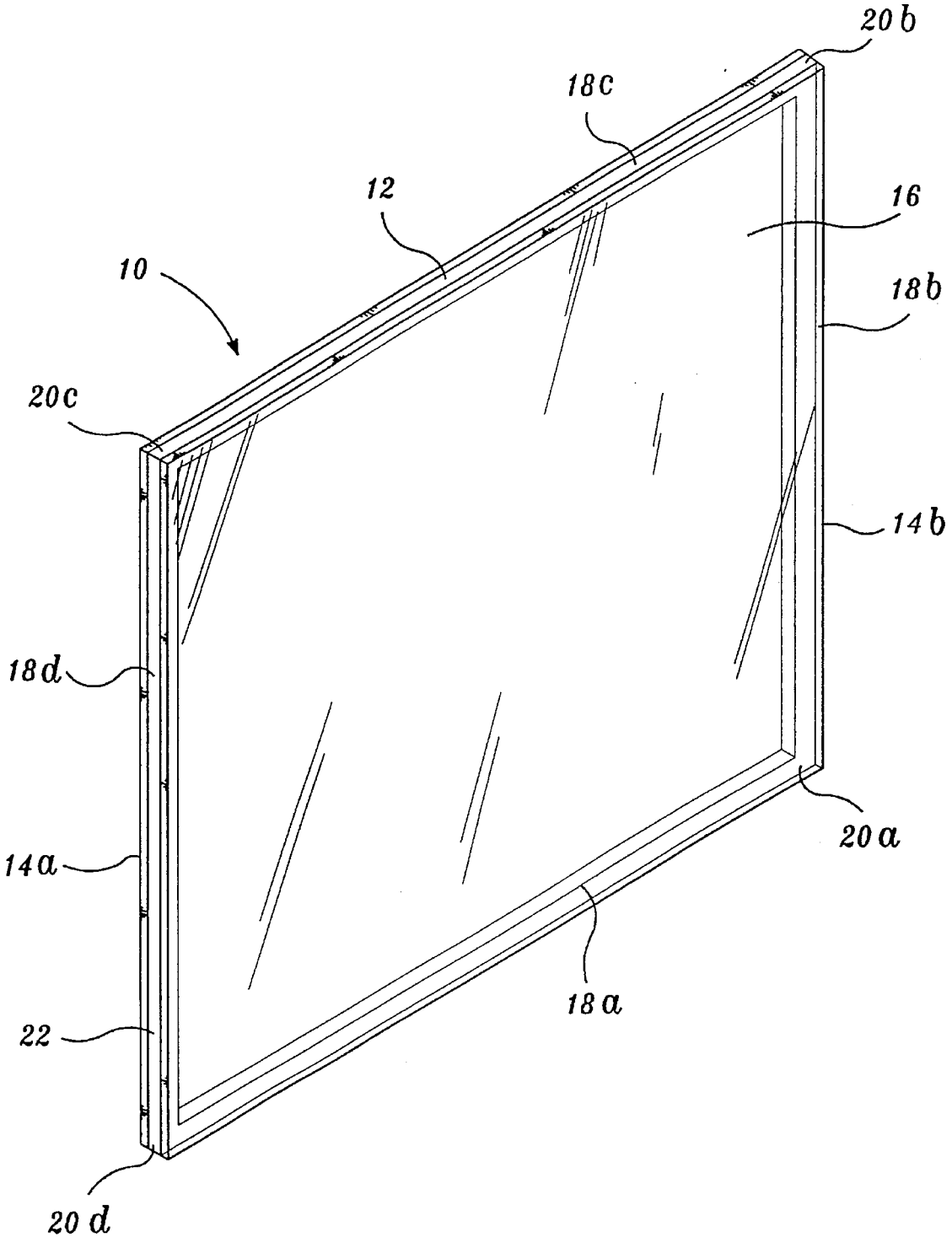
FIG. 1 is a perspective view of one embodiment of an insulated glass panel constructed according to the invention.

An insulated glass panel 10 made in accordance with the present invention is illustrated by FIG. 1. The insulated glass panel includes an essentially rectangular spacer frame 12 sandwiched between glass panes 14*a* and 14*b* or equivalent material, and bonded in place to the glass panes 14 to provide a hermetic airspace 16 bounded by the glass panes and the spacer frame. The spacer frame 12 extends completely around the outer periphery of the insulated glass panel 10 adjacent the peripheral edges of the glass panes 14 and is formed by segments of spacer-frame bars 18*a*, 18*b*, 18*c*, and 18*d*, each forming one side of the spacer frame 12. The spacer-frame bars are joined at their ends in some known manner to define spacer-frame comers 20*a*, 20*b*, 20*c*, and 20*d*.

Figure 2:
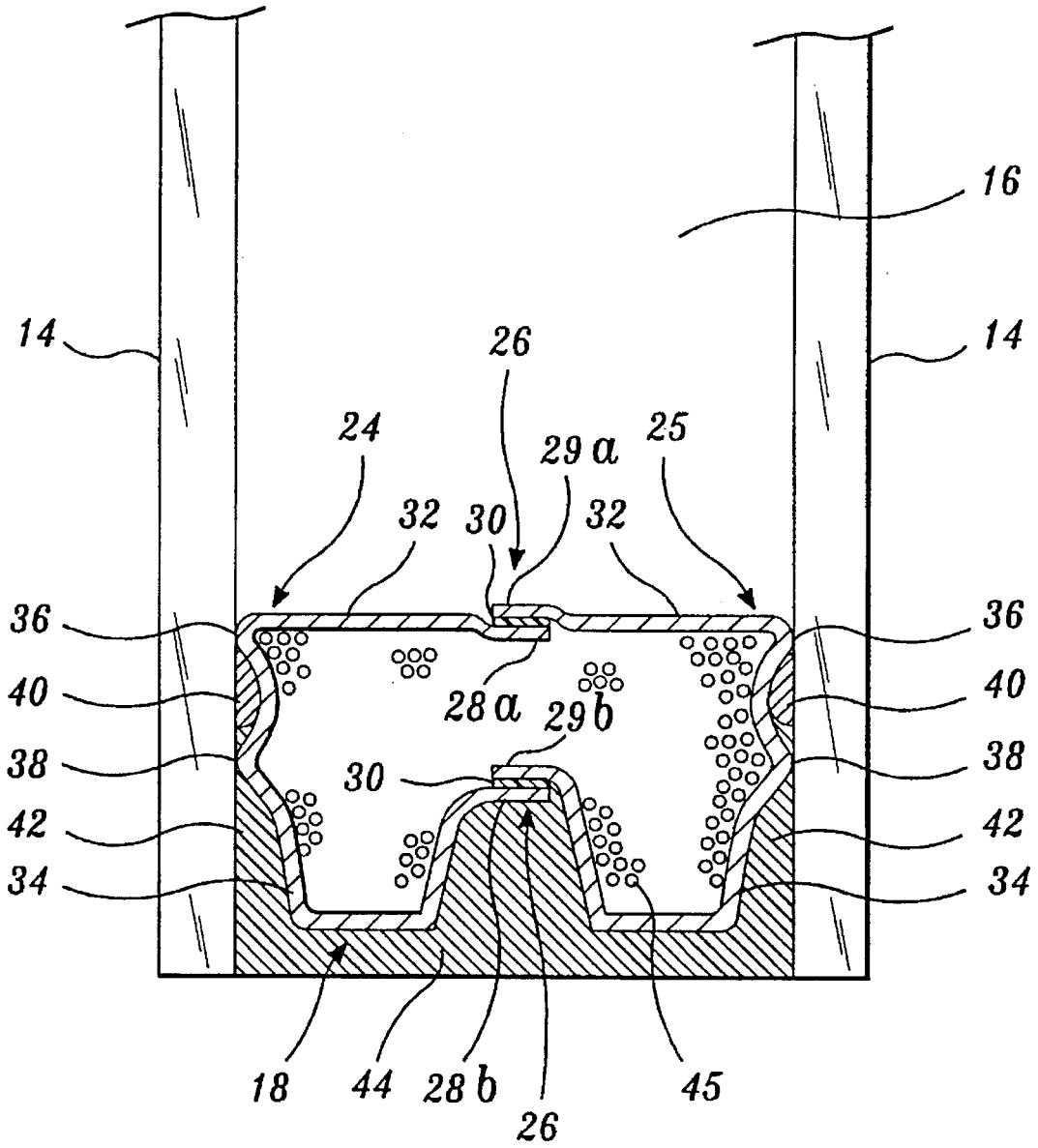
FIG. 2 is a cross-sectional view of an insulated glass panel showing a spacer-frame bar having an integral thermal break, positioned between two glass panes.

As illustrated by FIG. 2 in conjunction with FIG. 1, each spacer-frame bar 18 is formed by joining two halves of a thin-walled elongate metal tube of generally square cross-sectional shape, one half constituting a first side 24 and the other half constituting a second side 25, to form seams 26. First side 24 has an upper elongate edge 28*a* and a lower elongate edge 28*b*, while second side 25 has an upper elongate edge 29*a* and a lower elongate edge 29*b*. The elongate edges 28 and 29 of the first and second sides, respectively, are separated along the seam by an insulating member 30. Both the first side 24 and the second side 25 have a flat upper surface 32, along with side surfaces 34 having ridges 36 and 38. The ridge 36 is formed near the upper surface of each side, while the ridge 38 is formed near the midpoint of each side. The ridges protrude from the sides 24 and 25 to form recesses 40 such that, when the sides are joined and placed between the glass panes 14, the contact area between the upper sides and the glass panes is minimized. The sides 24 and 25 are sloped inward, from the ridges 38 and away from the glass panes 14 such that an area 42 is provided between the lower sides and the glass panes, again minimizing the contact area between the sides 24 and 25 and the glass panes 14. A sealant body 44, preferably a mastic-like material, extends about the outer periphery of the insulated glass panel 10, formed into the recesses 40 as well as into other spaces between the sides 24 and 25 and the glass panes 14. The sealant body assures that the glass panes are hermetically bonded to the spacer frame 12.

Each spacer-frame bar is filled with a particulate desiccant material 45. The interior of the spacer-frame bar is in communication with airspace 16 via the seams 26. The desiccant material is effective to dehumidify air that is trapped in airspace 16 during assembly of the insulated glass panel 10 so that the possibility of condensation of moisture from the air entrapped in the airspace is avoided.

Figure 3:
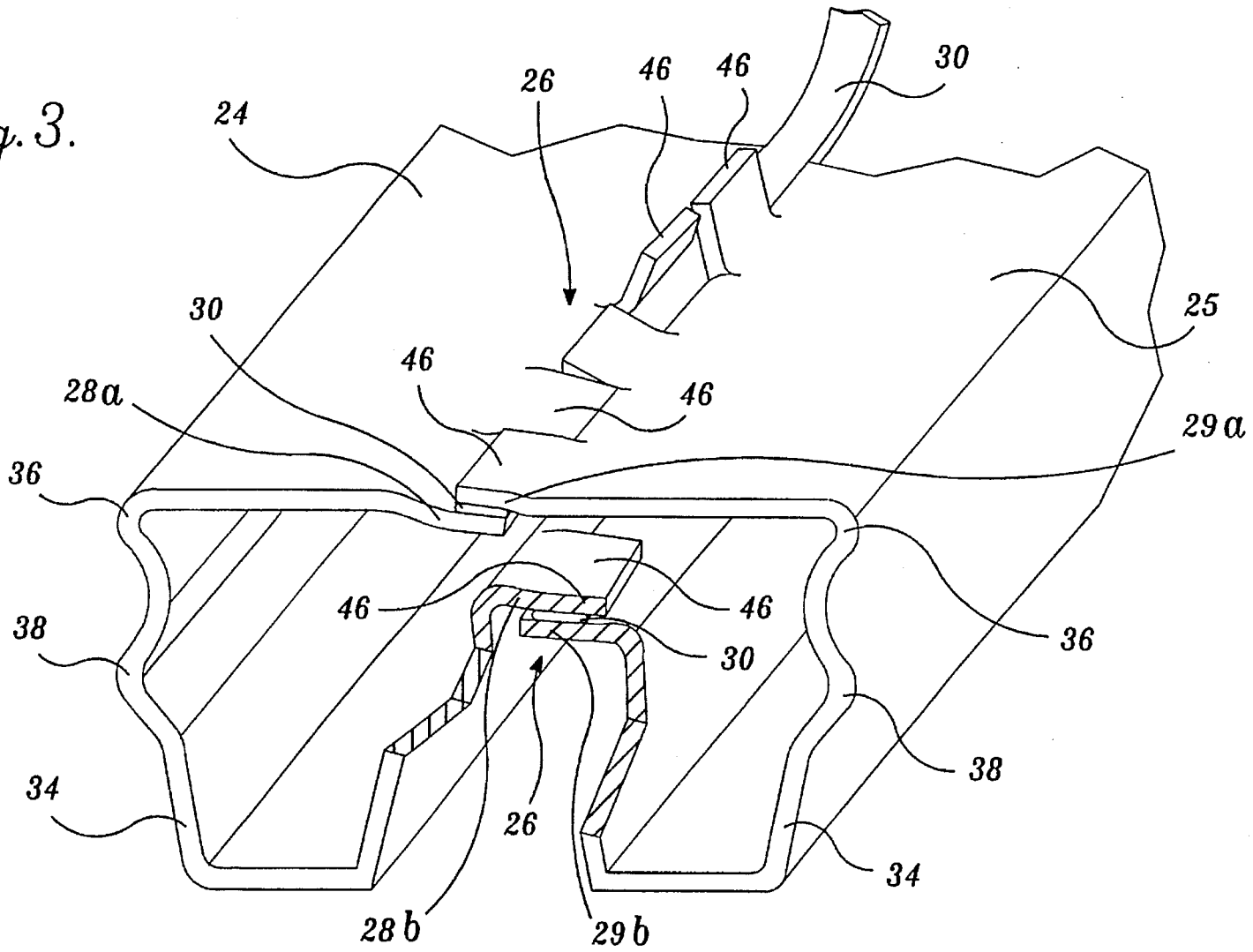
FIG. 3 is a fragmentary cross-sectional view of a spacer-frame bar wherein the integrated thermal break comprises opposed interleaved tabs formed in a first and a second side of the spacer-frame bar.

In the preferred embodiment of the invention, and as illustrated by FIG. 2 and 3, the elongate edges 28 and 29 of the first side 24 and the second side 25 are cut and formed into alternating tabs 46. Each tab 46 is cut to approximately the same size and to substantially the same depth, and it should be realized that the exact size and depth used may be varied to accommodate various sizes of spacer-frame designs without violating the spirit of this invention. When initially formed, the tabs of the first side 24 are aligned to oppose the tabs of the second side 25. Each tab is alternately deflected upward or downward, opposite the tab on the opposed side. As the first and second sides are joined to form the seam 26, the insulating member 30 is inserted between the opposing tabs. The insulating member 30 is preferably a strip of continuous nonmetallic, low-heat-conductive material, such as rubber, the length of the spacer-frame bar. The tabs 46 of the opposed sides 24 and 25 are subsequently pressed together and closed so as to interlock with each other, alternately overlying and underlying one another in an interleaved fashion, and separated by the insulating member. With careful placement of the insulating member 30 between the alternating tabs 46, metal-to-metal contact and therefore energy transfer between the first and second sides can be substantially reduced or eliminated.

Figure 4D:
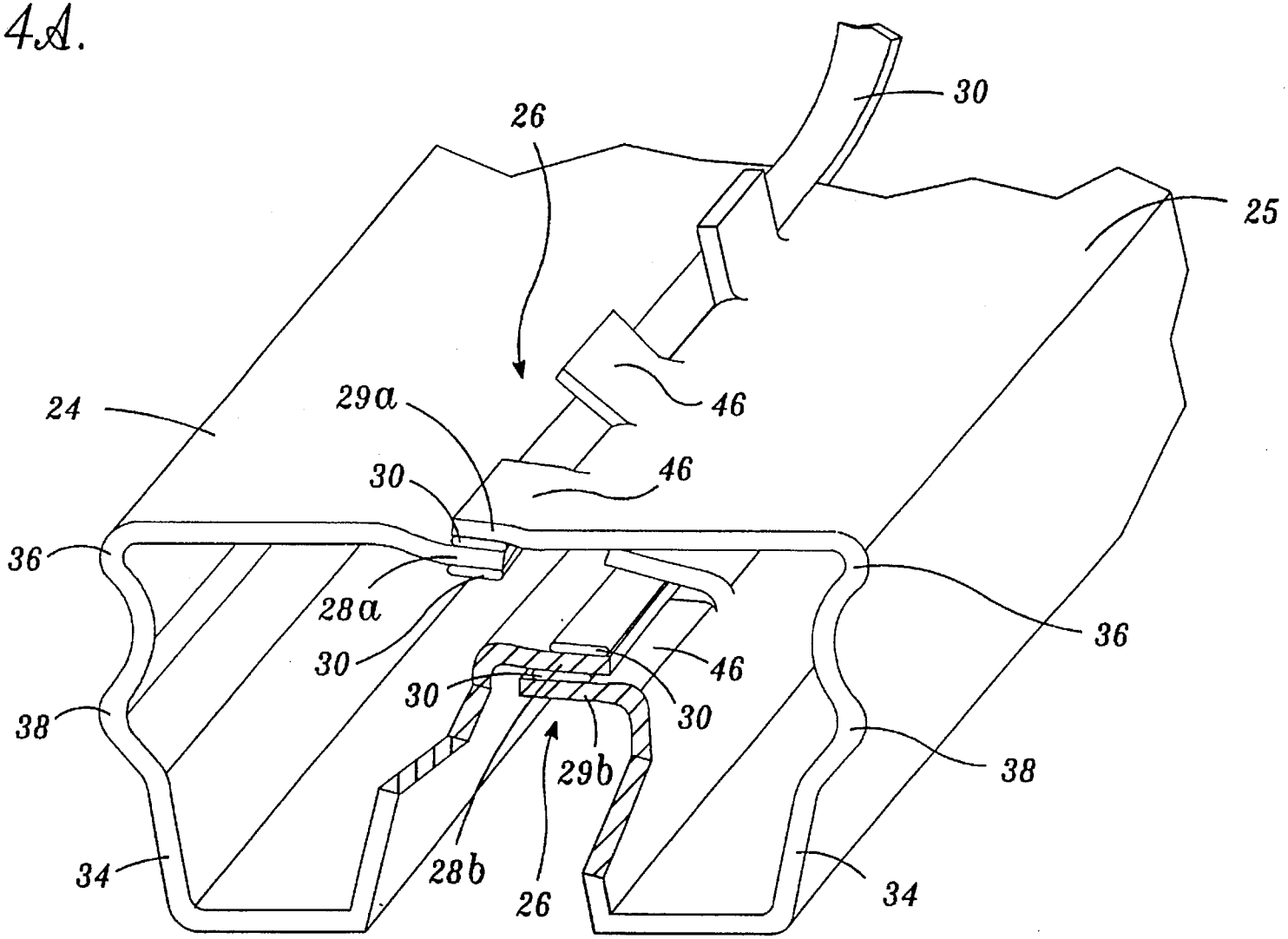
FIG. 4A is a fragmentary cross-sectional view of a spacer-frame bar wherein the integrated thermal break comprises tabs formed in the second side that alternately overlie and underlie the first side and multiple insulating members.
FIG. 4B is a fragmentary cross-sectional view of a spacer-frame bar wherein the integrated thermal break comprises tabs formed in the second side that alternately overlie and underlie the first side and a single V-shaped insulating member.
Figure 4B:
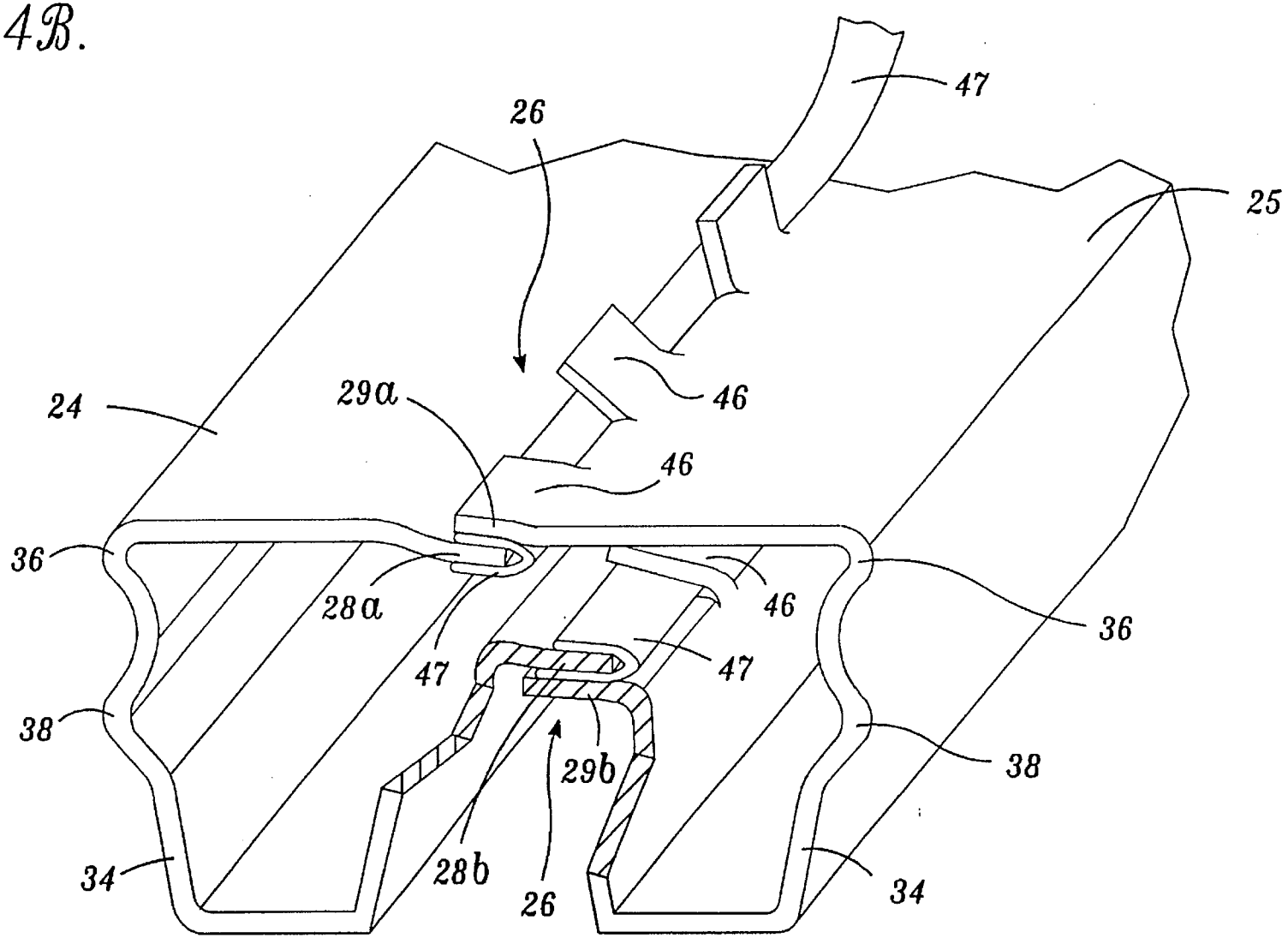

FIG. 4A illustrates an alternate embodiment of a spacer-frame bar constructed in accordance with the present invention. The spacer-frame bar of this embodiment is identical to that of the preferred embodiment save for the construction of its seams 26. In this embodiment, the elongate edges 28*a* and 28*b* of the first side 24 are untabbed and flat. The elongate edges 29*a* and 29*b* of the second side 25 are cut and formed into alternating tabs 46 as described above. Again, each tab 46 is cut to approximately the same size and to substantially the same depth. When initially formed, the tabs of the second side 25 are aligned to oppose the elongate edges 28 of the first side 24, each tab 46 alternately deflected upward or downward on either side of the edges of the first side. In one implementation of this embodiment, as shown in FIG. 4A, as the first and second sides are joined to form the seams 26, two identical insulating members 30 are inserted on either side of each edge 28*a* and 28*b* of the first side 24, between the opposing tabs 46 of the edges 29*a* and 29*b*, respectively, of the second side 25. The tabs 46 of the second side 25 are subsequently pressed together and closed so as to compress the first side 24, separated by the insulating members. In another implementation of this embodiment, shown in FIG. 4B, as the first and second sides are joined to form the seams 26, a single V-shaped insulating member 47, which extends over each edge 28 of the first side 24 and between the alternately overlying and underlying tabs of each edge 29 of the second side 25, is used.

Figure 5:
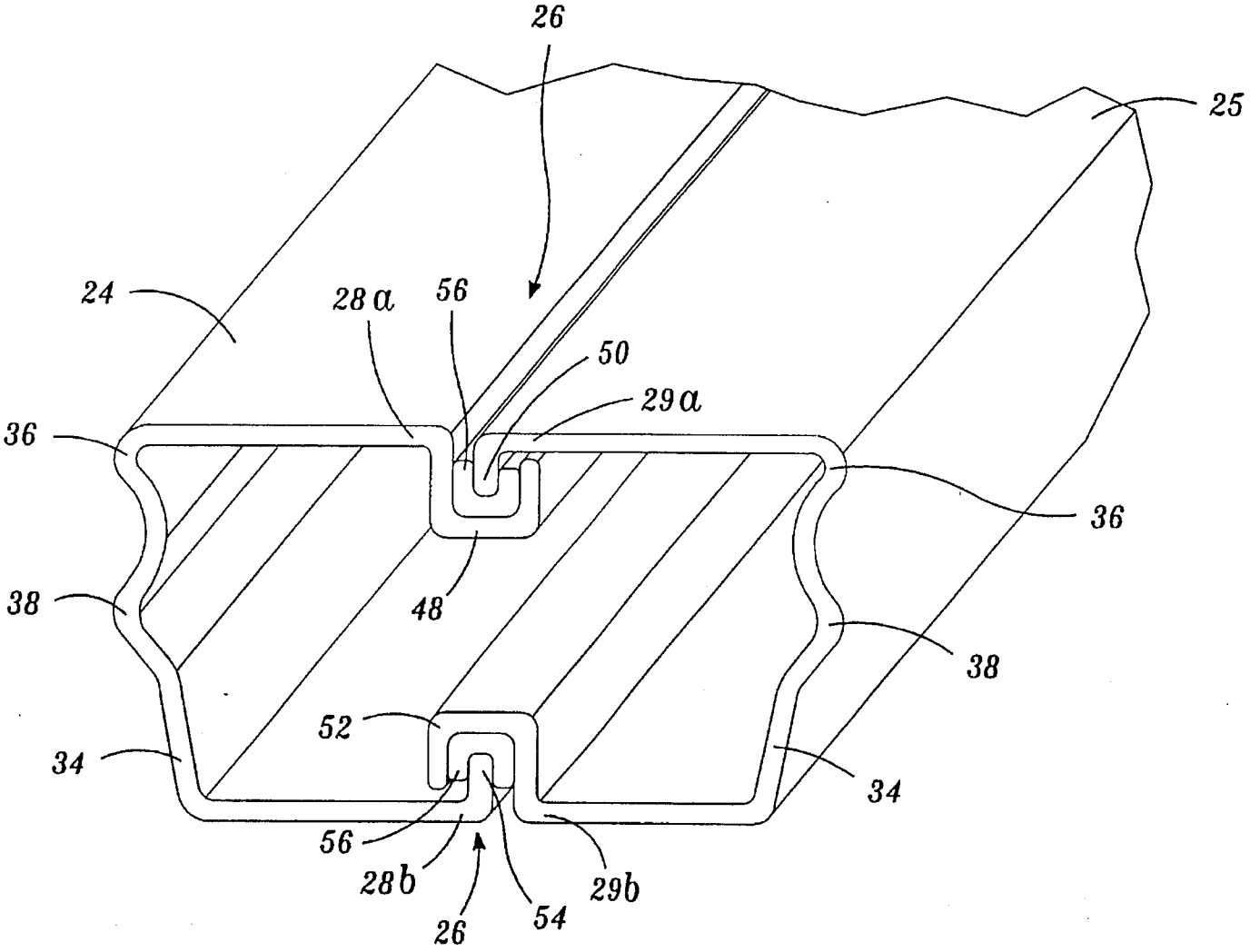
FIG. 5 is a fragmentary cross-sectional view of a spacer-frame bar wherein the integrated thermal break comprises an elongate channel formed along the edge of the first side corresponding to a ridge formed along the edge of the second side.

FIG. 5 illustrates another alternate embodiment of a spacer-frame bar constructed in accordance with the present invention. Its cross-sectional configuration is similar to the spacer-frame bar of FIGS. 3 and 4 with the exception of the central portion and seams 26. In this embodiment, the first side 24 has an elongate channel 48 formed along its edge 28*a*, corresponding to and sized to receive and interfit with a ridge 50 formed along the edge 29*a* of the second side 25. In a similar fashion, the second side 25 has an elongate channel 52 formed along its edge 29*b*, corresponding to and sized to receive and interfit with a ridge 54 formed along the edge 28*b* of the first side 24. Both elongate channels 48 and 52 of the first and second sides, respectively, are U-shaped extending toward the interior of the spacer-frame bar, their terminating ends parallel to the side surfaces 34. Ridges 50 and 54 extend toward the interior of the spacer-frame bar and within the U-shaped channels 48 and 52, respectively, and are parallel to the side surfaces 34. As the first and second sides are joined to form the seams 26, insulating members 56 are seated between the channels 48 and 52 and the corresponding ridges 50 and 54 of the first and second sides, respectively.

Figure 6:
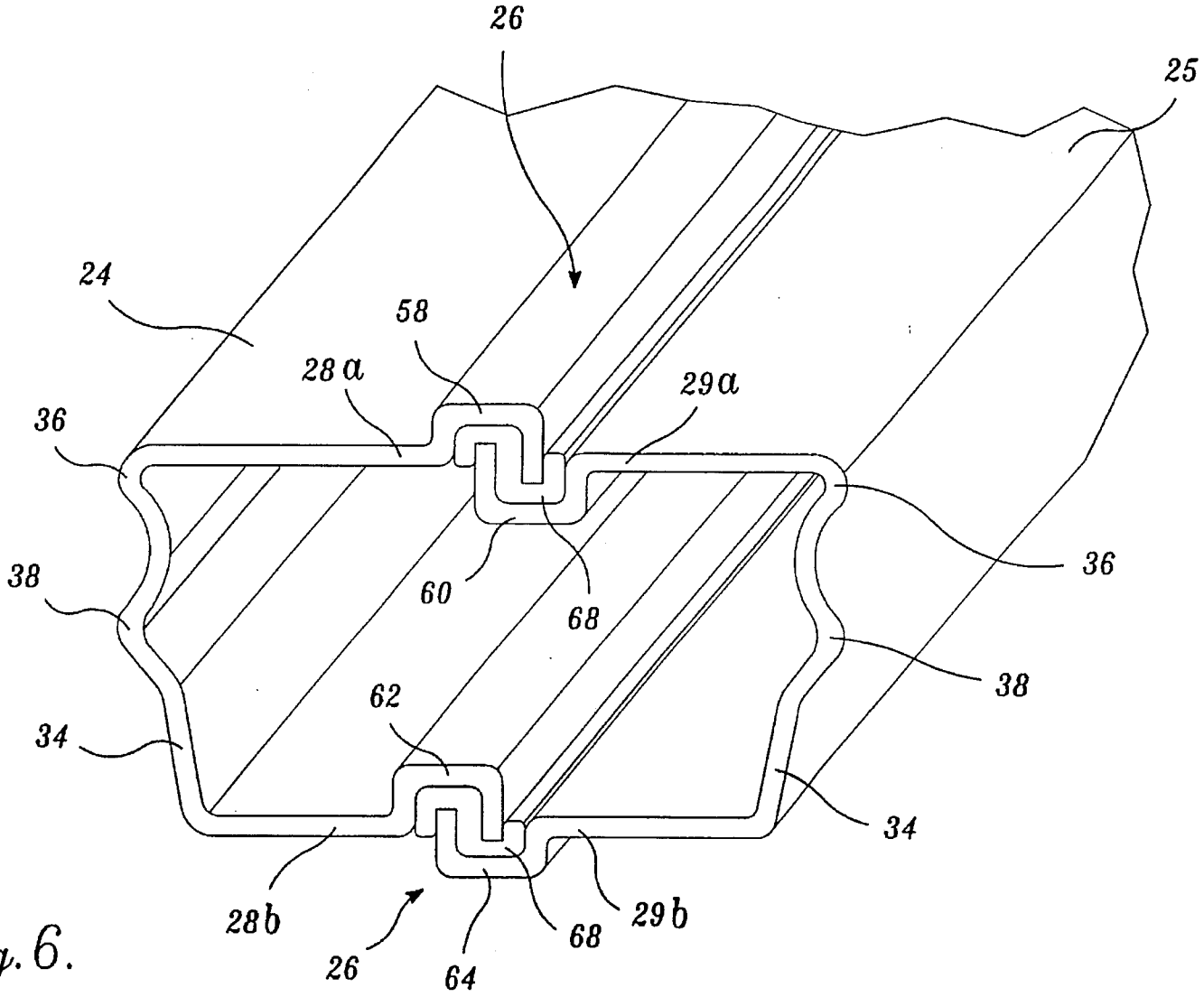
FIG. 6 is a fragmentary cross-sectional view of a spacer-frame bar wherein the integrated thermal break comprises an elongate channel formed along the edge of the first side and a corresponding elongate channel formed along the edge of the second side, the ends of the channels vertical with respect to the orientation of the spacer-frame bar and the channels interlocking to form the thermal break.
Figure 7:
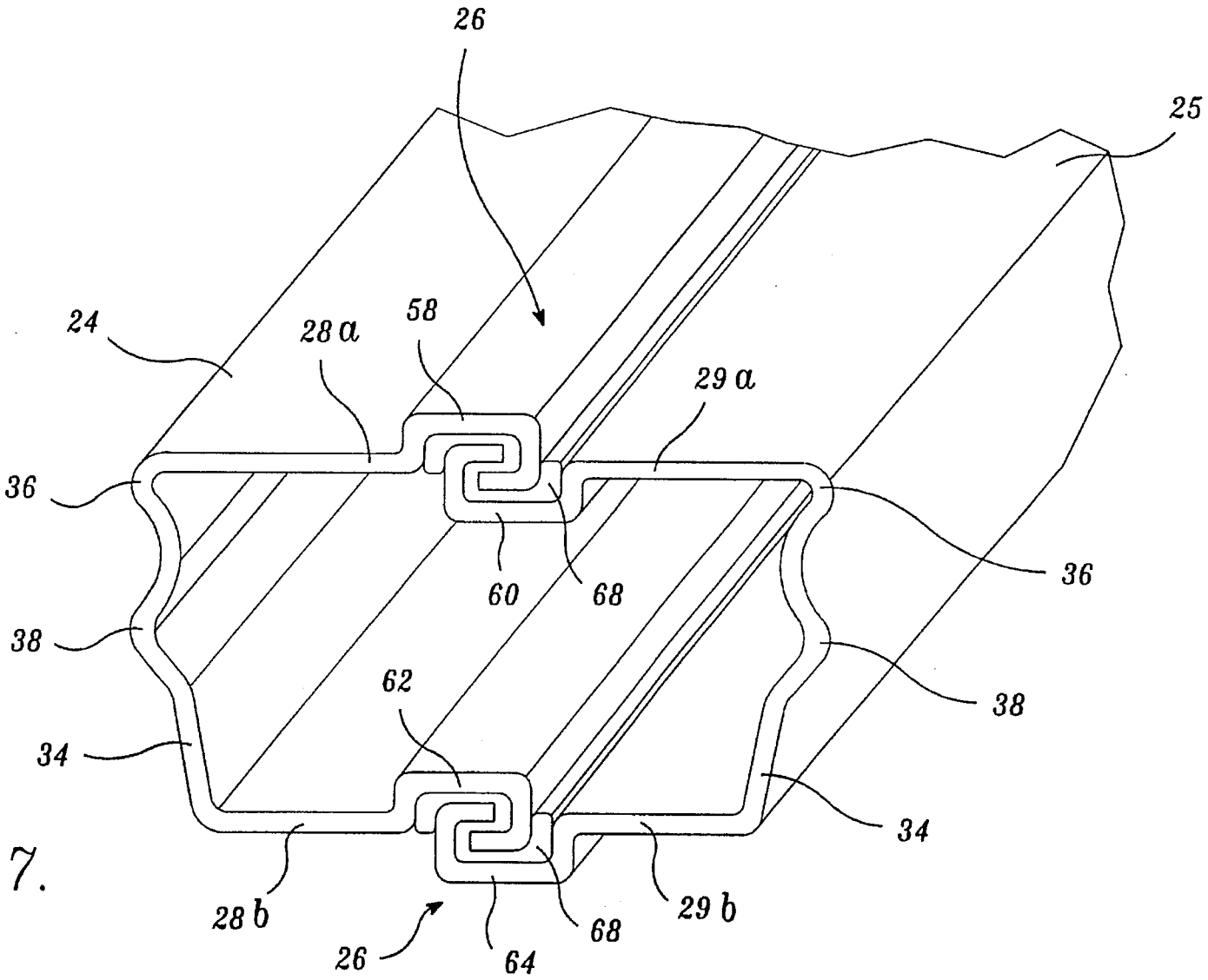
FIG. 7 is a fragmentary cross-sectional view of a spacer-frame bar wherein the integrated thermal break comprises an elongate channel formed along the edge of the first side and a corresponding elongate channel formed along the edge of the second side, the ends of the channels horizontal with respect to the orientation of the spacer-frame bar and the channels interlocking to form the thermal break.

FIG. 6 illustrates yet another alternate embodiment of a spacer-frame bar constructed in accordance with the present invention. Its cross-sectional configuration is similar to the spacer-frame bar of FIGS. 3–5, with the exception of the central portion seams 26. In this embodiment, the first side 24 has an elongate channel 58 formed along its edge 28*a*, corresponding to and sized to receive and interfit with an elongate channel 60 formed along the edge 29*a* of the second side 25. In a similar fashion, the first side 24 has an elongate channel 62 formed along the edge 28*b*, corresponding to and sized to receive and interfit with an elongate channel 64 formed along the edge 29*b* of the second side 25. Both elongate channels 58 and 62 of the first side 24 are U-shaped and have their terminating ends parallel to the side surfaces 34. Channel 58 extends away from the interior of the spacer-frame bar, while channel 62 extends toward the interior of the spacer-frame bar. In a similar fashion, both elongate channels 60 and 64 of the second side are U-shaped and have their terminating ends parallel to the side surfaces 34. Channel 60 extends toward the interior of the spacer-frame bar, opposite to and interlocking with channel 58 of the first side 24. In a similar fashion, channel 64 of the second side 25 extends away from the interior of the spacer-frame bar, opposite to and interlocking with channel 62 of the first side 24. As the first and second sides are joined to form the seams 26, insulating members 68 are seated between the channels 58 and 62 of the first side and the corresponding channels 60 and 64 of the second side, respectively. FIG. 7 illustrates an alternate embodiment of the spacer-frame bar shown in FIG. 6 above, in which the elongate channels formed along the edges of sides 24 and 25 are J-shaped, instead of U-shaped, such that their terminating ends are perpendicular to the side surfaces 34.

The above embodiments have described the use of continuous insulating members in forming a thermal break between the sides of the spacer-frame bar. While the critical element of the present invention is the thermal break, as opposed to the method of creating the thermal break, it will be appreciated that the thermal break may be formed in alternate manners and by alternate methods. For instance, the thermal break could be formed by spraying an insulating material along the alternate tabs or continuous edges of the sides such that a layer of insulating material is interposed between the opposing sides of the seam to prevent contact between sides. If applied to the alternately overlying and underlying tabs formed in the edges of the sides, the insulating material would be noncontinuous along the length of the spacer-frame bar. Alternately, the thermal break could be formed by interposing separators, such as rivets, made of an insulating material, between the alternate tabs, or interspaced periodically along the continuous edges of the sides, preventing contact between the sides. The thermal break in this latter embodiment would be the combination of the interposed separators and the resulting airspace between the sides of the seam.

It can be seen that the present invention provides an improved insulating glass panel that incorporates many novel features and offers significant advantages over the prior art. It will be apparent to those of ordinary skill that the embodiments of the invention illustrated and described herein are exemplary only. Changes can be made to any of the foregoing embodiments while remaining within the scope of the present invention. For example, the cross-sectional configuration of the spacer-frame bar or the configuration of the insulating member and cooperating sections of the sides can be varied. In addition, a number of different substances, such as plastic or fiber, can be used to achieve a similar thermal break effect. Further, the panes could be made of a material other than glass, such as plastic. The invention should be defined solely with reference to the claims herein.

The embodiments of the invention in which an exclusive property or privilege is claimed are defined as follows:

1. An elongate tubular spacer-frame bar for use in an insulated glass panel, comprising:

(a) a spacer-frame bar having first and second sides, each side having a side surface having first and second elongate edges, extending therefrom the first and second elongate edges of the first side corresponding to the first and second nonwelded elongate edges of the second side, respectively;

(b) first and second nonweld seams running along the elongate dimension of the spacer-frame bar between the corresponding first edges of said first and second sides and second edges of said first and second sides, respectively, such that in at least one of said first and second seams the corresponding edges of said first and second sides overlap each other to form the at least one of said first and second seams so as to provide structural strength between said first and second sides; and (c) means for thermally insulating said first side from said second side along said first and second seams.

2. The spacer-frame bar of claim 1, wherein said at least one of said first and second seams includes a series of tabs formed in the first edge of said first side and opposed to a series of tabs formed in the first edge of said second side, the opposing tabs alternately overlying and underlying one another in an interleaved fashion.

3. The spacer-frame bar of claim 2, wherein said insulating means includes at least one insulating member woven between the interleaved tabs of the first edges of said first and second sides.

4. The spacer-frame bar of claim 2, wherein said insulating means includes a layer of insulating material interposed between the opposing alternately overlying and underlying tabs.

5. The spacer-frame bar of claim 2, wherein said insulating means includes nonconductive separators interposed between the alternately overlying and underlying tabs to prevent contact between the first edges of said first and second sides.

6. The spacer-frame bar of claim 1, wherein said at least one of said first and second seams includes a series of tabs formed in the first edge of said first side that alternately overlie and underlie the corresponding first edge of said second side.

7. The spacer-frame bar of claim 6, wherein said insulating means includes at least one insulating member along the first edge of said second side between the alternately overlying and underlying tabs of the first edge of said first side.

8. The spacer frame bar of claim 6, wherein said insulating means includes at least one V-shaped member that extends over the first edge of said second side and between the alternately overlying and underlying tabs of the first edge of said first side.

9. The spacer-frame bar of claim 6, wherein said insulating means includes a layer of insulating material interposed between the first edge of said second side between the alternately overlying and underlying tabs of the first edge of said first side.

10. The spacer-frame bar of claim 6, wherein said insulating means includes nonconductive separators interposed between the first edge of said second side and between the alternately overlying and underlying tabs of the first edge of said first side to prevent contact between the first edges of said first and second sides.

11. The spacer-frame bar of claim 1, herein said at least one of said first and second seams includes an elongate channel formed along the first edge of said first side and a corresponding ridge formed along the first edge of said second side, the ridge being received by the channel to form said seam.

12. The spacer-frame bar of claim 11, wherein said insulating means includes at least one member adapted to seat between the elongate channel of said first side and the corresponding ridge of said second side.

13. The spacer-frame bar of claim 11, wherein said insulating means includes a layer of insulating material interposed between the elongate channel of said first side and the corresponding ridge of said second side.

14. The spacer-frame bar of claim 11, wherein said insulating means includes nonconductive separators interposed between the elongate channel of said first side and the corresponding ridge of said second side, and interspaced to prevent contact between the edges of said first and second sides.

15. The spacer-frame bar of claim 1, wherein said at least one of said first and second seams includes an elongate channel formed along the first edge of said first side and a corresponding elongate channel formed along the first edge of said second side, the channels interfitting to form said seam.

16. The spacer-frame bar of claim 15, wherein said insulating means includes at least one member adapted to seat between the elongate channel of said first side and the corresponding elongate channel of said second side.

17. The spacer-frame bar of claim 15, wherein said insulating means includes a layer of insulating material interposed between the elongate channel of said first side and the corresponding elongate channel of said second side.

18. The spacer-frame bar of claim 15, wherein said insulating means includes nonconductive separators interposed between the elongate channel of said first side and the corresponding elongate channel of said second side, and interspaced to prevent contact between the edges of said first and second sides.

19. The spacer-frame bar of claim 1, wherein said insulating means is a continuous member being of a length substantially equal to the length of said spacer-frame bar.

20. The spacer-frame bar of claim 1, wherein said insulating means is composed of a nonmetallic, low-heat-conductive substance.

21. The spacer-frame bar of claim 10, wherein said insulating means is composed of rubber.

22. The spacer-frame bar of claim 10, wherein said insulating means is composed of plastic.

23. The spacer-frame bar of claim 1, wherein said first seam includes a series of tabs formed in the first edge of said first side that alternately overlie and underlie the corresponding first edge of said second side, and said second seam includes a series of tabs formed in the second edge of said second side that alternately overlie and underlie the corresponding second edge of said first side.

24. The spacer-frame bar of claim 1, wherein said first seam includes an elongate channel formed along the first edge of said first side and a corresponding ridge formed along the first edge of said second side, said second seam includes an elongate channel formed along the second edge of said first side and a corresponding ridge formed along the second edge of said second side, and the ridges are received by the channels to form said first and second seams, respectively.

25. A spacer-frame bar having an integral thermal break used to space first and second glass panes, comprising:

(a) first and second side channel members, each formed to define a longitudinal side surface for contacting a corresponding glass pane, and longitudinal upper and lower walls projecting from the side surface, inner edge portions of the upper and lower walls of the first side channel member overlapping inner edge portions of the upper and lower walls of the second side channel member in a direction transverse to said side surfaces; and (b) means for securing the overlapped inner edge portions of the first and second side channel members together to define nonwelded upper and lower longitudinal seams, wherein the means for securing includes first and second elongate thermal insulating strips captured between the overlapped inner edge portions of the first and second side channel members.

* * * * *

UNITED STATES PATENT AND TRADEMARK OFFICE

CERTIFICATE OF CORRECTION

PATENT NO. : 5,568,714
DATED : October 29, 1996
INVENTOR(S) : W.H. Peterson

It is certified that error appears in the above-indentified patent and that said Letters Patent is hereby corrected as shown below:

| COLUMN | LINE | |
|---|---|---|
| 6 (Claim 1, | 59 line 7) | Delete "nonwelded" |
| 6 (Claim 1, | 61 line 9) | "nonweld" should read --nonwelded-- |
| 6 (Claim 1, | 67 line 15) | After "each other" insert --in a direction transverse to said side surfaces-- |
| 7 (Claim 11, | 48 line 1) | "herein" should read --wherein-- |

Signed and Sealed this

Twentieth Day of May, 1997

Bruce Lehman

*Attest:*

BRUCE LEHMAN

*Attesting Officer*

*Commissioner of Patents and Trademarks*